United States Patent [19]

Bloeck et al.

[11] Patent Number: 4,529,468

[45] Date of Patent: Jul. 16, 1985

[54] PROCESS OF HEAT SEALING A CLOSURE STRIP TO A CAN LID

[75] Inventors: Siegfried Bloeck; Oldrich Stanek, both of Kreuzlingen, Switzerland

[73] Assignee: Swiss Aluminium Ltd., Chippis, Switzerland

[21] Appl. No.: 522,494

[22] Filed: Aug. 12, 1983

[30] Foreign Application Priority Data

Sep. 2, 1982 [CH] Switzerland ..... 5218/82

[51] Int. Cl.[3] ..... B32B 31/12

[52] U.S. Cl. ..... 156/320; 156/69; 156/330.9; 220/269; 220/359; 413/8; 428/35; 428/43

[58] Field of Search ..... 156/69, 309.9, 320, 156/322, 330.9; 220/260, 269, 270, 276, 359; 413/8; 428/192, 35, 43

[56] References Cited

U.S. PATENT DOCUMENTS

| | | | |
|---|---|---|---|
| 3,850,725 | 11/1974 | Spielau et al. | 156/309.9 X |
| 4,029,033 | 6/1977 | Kerwin et al. | 156/69 X |
| 4,101,534 | 7/1978 | Ueno et al. | 156/330.9 X |
| 4,253,584 | 3/1981 | Bloeck et al. | 220/359 |
| 4,333,582 | 6/1982 | Bloeck et al. | 220/66 |
| 4,461,605 | 7/1984 | Stanek et al. | 413/8 |
| 4,462,732 | 7/1984 | Bloeck | 156/69 X |

*Primary Examiner*—Robert A. Dawson

*Attorney, Agent, or Firm*—Bachman & LaPointe

[57] ABSTRACT

A process for manufacturing a lid having at least one outlet opening wherein a closure strip is sealed onto the lid covering the outlet opening comprising heating the closure strip to a temperature range of approximately 115°–170° C. within 10–15 seconds prior to sealing the closure strip onto the lid.

1 Claim, No Drawings

PROCESS OF HEAT SEALING A CLOSURE STRIP TO A CAN LID

BACKGROUND OF THE INVENTION

The invention relates to a process for manufacturing a lid which is coated at least on its outer surface, in particular a painted metal lid for beverage cans, having at least one pouring outlet and such that a closure strip with sealable coating is sealed onto it at least closing off the pouring outlet, said strip being, if desired, shaped from a strip or the like coated with a sealable material.

Today, beverage cans are generally made as one piece cans from tin plate, tin-free steel or aluminum and, after filling with the desired contents, closed off with a lid likewise made from the above mentioned materials. In an earlier stage this lid is provided with an outlet opening, for example by stamping, which is then closed off again by a closure strip. The lid features a coating of paint or lacquer, for example of phenolic-epoxy resin, the closure strip e.g. of thin aluminum strip a coating of a thermoplastic plastic, for example a polyamide. The lid is placed on a pre-heated lower sealing tool and the closure strip sealed around the outlet opening by melting the polyamide sealing layer by means of an upper sealing tool.

As the strength of bonding of the sealing layer to the painted surface of the lid is of great importance for the use of the can, considerable attention must be given to this feature. The strength or resistance of this bond is influenced in particular by:

- the positioning of the lid at the sealing station
- the flatness in the region of the opening
- the distribution of the compressive load on sealing
- the thickness and breadth of the seal
- the temperatures of the upper and lower sealing tools
- the flanging conditions
- the possible level of pressure inside the closed can
- the conditions of storing the filled can
- the head space on the filled can
- the storing conditions for the lacquer on the outside of the can lid or the like.

In view of the above factors which affect seal strength, simple sealing-on of the closure strip is not sufficient, in particular for beverage cans holding drinks containing $CO_2$. The seal on such cans must withstand an internal pressure of more than 4 bar and temperatures in excess of 30° C. over extended periods of time.

To improve the bond strength of the seal, it was suggested therefore that, after sealing the closure strip onto the lid, this should be heated to melt the polyamide and then cooled again. The heating was carried out in a temperature range of 175° C. to 300° C. for a length of time which depended on the temperature employed. It turned out, however, that blisters formed on re-melting the seal; these blisters seriously impaired the effectiveness of the seal and, depending on the number of blisters present even destroyed the sealing effect.

The object of the present invention is, therefore, to develop a process of the kind described above by means of which blister formation is avoided, better storage properties are obtained and the bond strength between the closure strip and the lid is improved.

SUMMARY OF THE INVENTION

The foregoing object is achieved by way of the invention wherein the closure strip is heated shortly before and separate from the sealing operation. If the closure strip has to be formed, before sealing, from a strip or the like carrying a sealable material, it is within the scope of this invention for the strip or the like to be heated as a whole before the shaping of the closure strip.

With this process it was surprisingly found that no blisters formed on subsequent melting. On heating the closure strip a volatile and therefore blister creating substance is removed from the surface or from the interior of the sealable layer; the said volatile substance may to some extent be a film of moisture or the like.

DETAILED DESCRIPTION

The heating of the closure strip or the strip of its origin must take place shortly before sealing in order that the volatile and thus blister forming substance cannot re-form on the sealing layer. Trials showed that a time interval of 5–15 sec is adequate here. The heating facility should therefore be for example an infra-red heater, situated immediately in front of the sealing tool or the device stamping out the closure strip.

EXAMPLE

A thin aluminum strip coated with a polyamide layer was sealed onto a tin-free steel lid coated on both sides with lacquer. The upper sealing tool was at a temperature of 250° C., the lower at 170° C. The specific sealing pressure was 2000 N/cm$^2$. Before sealing, the thin aluminum strip passed through an oven which has been pre-heated to 170° C.

A series of trials was performed under these sealing conditions but with different dwell times for the strip in the oven, and with different delay times between the removal of the strip from the oven and the sealing operation. The following results concerning blister formation on subsequent melting were obtained:

| Duration of pre-heating | Delay time | Results |
|---|---|---|
| 5 sec | 15 sec | blisters |
| 10 sec | 15 sec | no blisters |
| 15 sec | 15 sec | no blisters |
| 30 sec | 30 sec | no blisters |
| 10 sec | 2 min | blisters |
| 10 sec | 5 min | blisters |

The results show that pre-heating the strip for about 10 sec is sufficient to prevent blister forming. In this time the strip in the pre-heating oven reaches a temperature of about 115°–120° C. The delay time between pre-heating and sealing should not exceed 30 sec. The selected duration of pre-heating and temperature of the oven depend on the production conditions. The limit is given, however, by the strip material itself as a strip which has been heated e.g. for 1 min at 170° C. can no longer be correctly sealed.

It was found, surprisingly, that such pre-heated strips or seals made with these strips withstand the so-called Gardner impact test (3 inch pounds) also without a special subsequent melting operation.

The seal produced by the process of the invention, if subjected to a subsequent melting operation—even at temperatures above 210° C. and a heating time of 1 min—, can be melted without producing blisters.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for manufacturing a lid having at least one outlet opening provided with a closure strip for sealing said opening comprising providing a metal lid having an outlet opening, providing a closure strip coated with a sealable layer, heating said closure strip to a predetermined temperature and thereafter sealing said preheated closure strip to said metal lid shortly after heating said closure strip wherein said closure strip is coated with a sealable polyamide layer and is heated to a temperature of about between 115° C. to 170° C. in about 10 seconds to 15 seconds and wherein said coated and heated strip is sealed to said can lid not more than 30 seconds after the heating of said closure strip.

* * * * *